US009859690B2

(12) United States Patent
Lam

(10) Patent No.: US 9,859,690 B2
(45) Date of Patent: Jan. 2, 2018

(54) IGNITION COIL ASSEMBLY WITH TERMINALS CONNECTING INSERT

(71) Applicant: Joe Luk Mui Lam, Johor Bahru (MY)

(72) Inventor: Joe Luk Mui Lam, Johor Bahru (MY)

( * ) Notice: Subject to any disclaimer, the term of this patent is extended or adjusted under 35 U.S.C. 154(b) by 636 days.

(21) Appl. No.: 14/395,964

(22) PCT Filed: Feb. 18, 2013

(86) PCT No.: PCT/MY2013/000030

§ 371 (c)(1),
(2) Date: Oct. 21, 2014

(87) PCT Pub. No.: WO2014/126452

PCT Pub. Date: Aug. 21, 2014

(65) Prior Publication Data

US 2015/0136485 A1 May 21, 2015

(51) Int. Cl.
*H01F 38/12* (2006.01)
*F02P 15/00* (2006.01)
(Continued)

(52) U.S. Cl.
CPC ..... *H01T 15/00* (2013.01); *F02P 3/02* (2013.01); *F02P 13/00* (2013.01); *H01B 1/04* (2013.01)

(58) Field of Classification Search
CPC .... H01T 15/00; H01B 1/04; F02P 3/02; F02P 13/00
See application file for complete search history.

(56) References Cited

U.S. PATENT DOCUMENTS 4,590,536 A 5/1986 Gerry
5,706,792 A 1/1998 Boyer et al.
(Continued)

FOREIGN PATENT DOCUMENTS

JP 2003-332155 11/2003
KR 10-2009-0081575 7/2009
KR 10-2009-0081590 7/2009

OTHER PUBLICATIONS

International Search Report of PCT/MY2013/000030 dated Nov. 25, 2013 (3 pages total).
(Continued)

*Primary Examiner* — Hieu T Vo
*Assistant Examiner* — Arnold Castro
(74) *Attorney, Agent, or Firm* — Hamre, Schumann, Mueller & Larson, P.C.

(57) ABSTRACT

An ignition system comprises an ignition coil assembly (100) that supplies a high voltage electric current to a resistor-type spark plug (20). The ignition coil assembly (100) includes an ignition coil (140), a high voltage coil terminal (120), a terminals connecting insert (30) and an insulator (40). The terminals connecting insert (30) conducts the high voltage current from the ignition coil (140) to the resistor-type spark plug (20) by connecting the high voltage coil terminal (120) of the ignition coil (140) to the electrode terminal (22) of the resistor-type spark plug (20). The conductor core (32) of the terminals connecting insert (30) is formed of electrically conducting elongated fibers of carbon fiber or graphite fiber. A conductor supporting body stem (34) of the terminals connecting insert (30) forms an insulating and protecting layer around the outside of the fiber conductor core (32). The insulator (40) provides a passageway to house the high voltage coil terminal (120), the terminals connecting insert (30), the electrode terminal (22) and portion of the resistor-type spark plug (20). The insulator (40) can be detachable as a separate component from the high voltage coil terminal (120) of the ignition coil (140) to form a detachable-insulator (42). The insulator (40) can be non-detachable from the high voltage coil terminal (120) to form a non-detachable-insulator (44). The non-detachable-insulator (44) is in a form of an integral part of an insulator (40) with the ignition coil (140).

38 Claims, 4 Drawing Sheets

Figure 1:
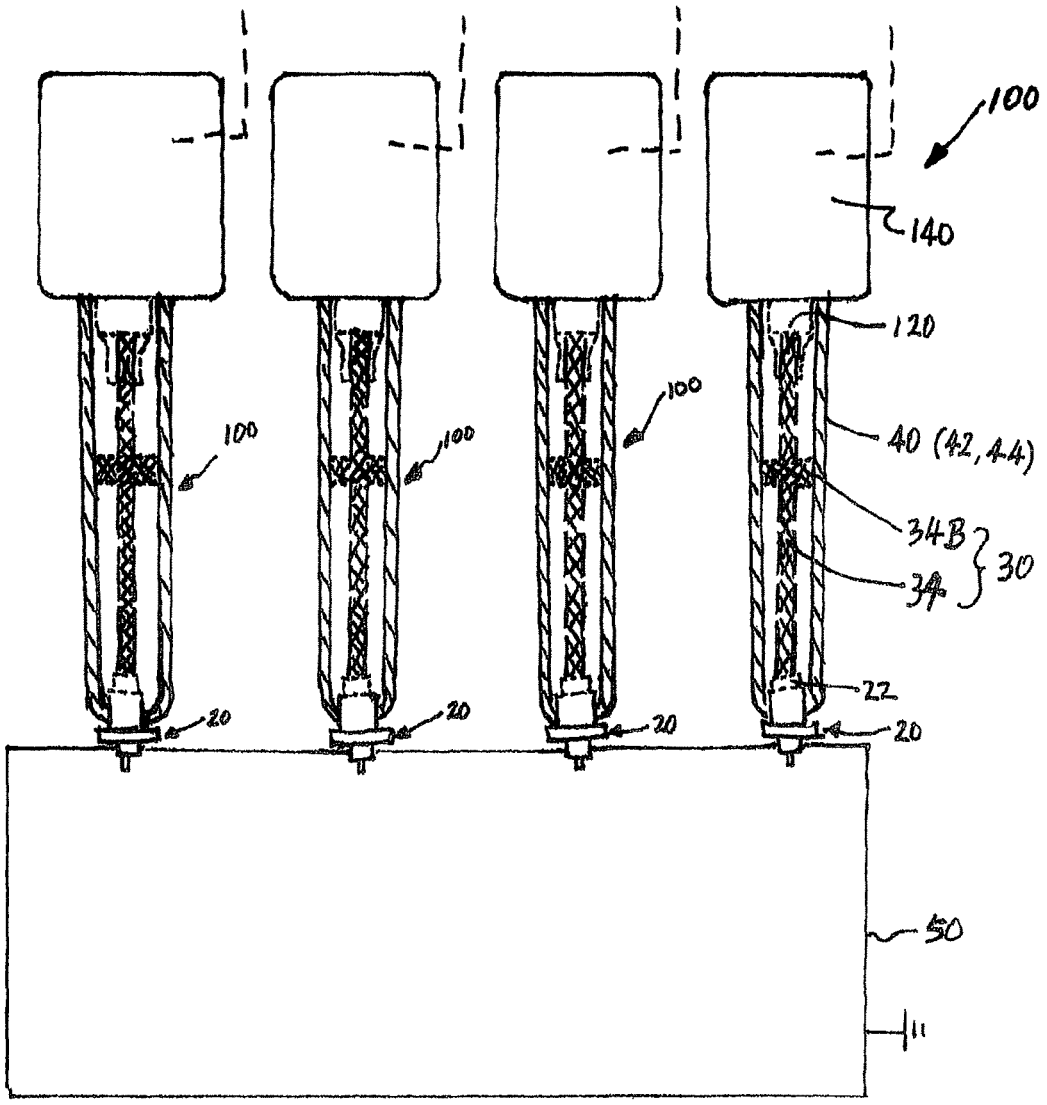

(51) Int. Cl.

| | |
|---|---|
| ***H01T 15/00*** | (2006.01) |
| ***F02P 3/02*** | (2006.01) |
| ***F02P 13/00*** | (2006.01) |
| ***H01B 1/04*** | (2006.01) |

(56) References Cited

U.S. PATENT DOCUMENTS

| | | | | |
|---|---|---|---|---|
| 6,427,673 | B2 | 8/2002 | Morganti et al. | |
| 6,443,137 | B1 | 9/2002 | Kraft et al. | |
| 6,668,810 | B1 | 12/2003 | St. John et al. | |
| 7,185,622 | B2 | 3/2007 | Doll | |
| 7,204,220 | B2 | 4/2007 | Schmidt et al. | |
| 2013/0299212 | A1* | 11/2013 | Hata ..... | B82Y 30/00 174/126.2 |

OTHER PUBLICATIONS

Written Opinion of the International Searching Authority of PCT/MY2013/000030 dated Nov. 25, 2013 (10 pages total).

* cited by examiner

IGNITION COIL ASSEMBLY WITH TERMINALS CONNECTING INSERT

BACKGROUND OF THE INVENTION

An ignition system of an internal combustion engine comprises an ignition coil assembly that supplies a high voltage electric current to a spark plug, for example: "Coil-on-Plug", and the ignition coil assembly includes an ignition coil, which is mounted directly on each of the spark plug to provide the advantages of the elimination of high voltage leads, simple and easy installation. The ignition coil assembly includes a conventional metallic coil spring type conductor to conduct the high voltage electric current from the high voltage coil terminal of the ignition coil to the electrode terminal of the spark plug. The recognized performance problem of such an ignition coil assembly includes the misfire which arises from the deterioration of the electrical conductivity of the metallic coil spring upon performance ageing, which leads to a gradual increase in the fuel consumption and emissions in conjunction with the loss of vehicle power. This is associated with the inferior corrosion resistance of the metallic coil spring under the harsh application conditions of combined high temperature and humidity environment. The other drawback of the metallic coil spring includes the possibility of dielectric failure due to the induction of electro-magnetic field concentration. It is an object of at least one embodiment of this invention to address these drawbacks of a typical ignition coil assembly that includes the metallic coil spring.

SUMMARY OF THE INVENTION

This invention includes the application of a terminals connecting insert as a replacement of conventional metallic coil spring for an ignition coil assembly associated with both the detachable-insulator and the non-detachable-insulator.

An ignition system of an internal combustion engine comprises an ignition coil assembly that supplies a high voltage electric current to a spark plug, which is preferably a resistor-type. In accordance with this invention, the ignition coil assembly includes: a terminals connecting insert that connects the high voltage coil terminal of an ignition coil to the electrode terminal of the resistor-type spark plug; a conductor core of the terminals connecting insert comprises a layer of a plurality of elongated fibres of carbon fibre or graphite fibre extending side-by-side and disposed at the innermost centre of the terminals connecting insert; a conductor supporting body stem of the terminals connecting insert forms an insulating and protecting layer around the outside of the fibre conductor core; and a detachable-insulator having an interior longitudinally extending passageway to house the high voltage coil terminal of the ignition coil, the terminals connecting insert and the electrode terminal of the resistor-type spark plug. The detachable-insulator forms a cylindrical housing to insulate the high voltage coil terminal of the ignition coil and the electrode terminal of the resistor-type spark plug.

The conductor core of the terminals connecting insert is in a form of elongated fibres of carbon fibre or graphite fibre being arranged in a bundle, and disposed along the centre line of the terminals connecting insert. The elongated fibres of the conductor core are derived from fibres selected from a group consisting of carbonization of man-made fibres, and coal tar and petroleum pitch. The man-made fibres may include synthetic polymers such as homopolymer and or copolymer of polyacrylonitrile. The man-made fibres may include natural polymers and their derivatives, such as cellulose and rayon. Preferably the fibre conductor core is derived from homopolymer and copolymer of polyacrylonitrile. The conductor core may include the elongated fibres without conductive coating. The plurality of elongated fibres may be coated with conductive composition having a resistivity of below 16 KΩ·m at 15° C., preferably below 5 KΩ·m at 15° C. The conductive composition may include synthetic latex, elastomers and thermoplastics. Preferably, the conductive composition is based on synthetic latex. The terminals connecting insert has a resistance per unit length most preferably less than 50 Ω/m. The terminals connecting insert conducts the high voltage electric current from the high voltage coil terminal of the ignition coil to the electrode terminal of the resistor-type spark plug.

The terminals connecting insert includes a conductor supporting body stem. The conductor supporting body stem may include a retainer supporting body stem. The retainer supporting body stem acts as a retainer means of the terminals connecting insert. The terminals connecting insert is in a tubular form of the conductor supporting body stem having outside diameter in the range of 2 mm to 20 mm. The terminals connecting insert may include a retainer supporting body stem having a configuration being branched out from the conductor supporting body stem. The retainer supporting body stem of the terminals connecting insert may form an integral molded part with the conductor supporting body stem. The terminals connecting insert may include the component assembly of the retainer supporting body stem with the conductor supporting body stem. The terminals connecting insert may include a solid structure of the conductor supporting body stem. In this invention, the terminals connecting insert has a configuration design based on the functional design of the conductor supporting body stem and the retainer supporting body stem. The configuration design of the terminals connecting insert includes the shapes of a cone, rhombus, rectangle, cylindrical, square, triangle and their combinations, most preferably derived from the cone and its combination. The terminals connecting insert may have different shapes.

The retainer supporting body stem may have outside diameter in the range of 4 mm to 24 mm, which acts as a retainer means to keep the terminals connecting insert remaining in a stable position along the passageway of the detachable-insulator during the installation and removal of the spark plug, and to uphold the centre line of terminals connecting insert in position adjacent the longitudinal centre lines of the detachable-insulator, the high voltage coil terminal of the ignition coil and the electrode terminal of the resistor-type spark plug. The terminals connecting insert may include at least one and less than three retainer supporting body stem. The conductor supporting body stem and the retainer supporting body stem of the terminals connecting insert may be fabricated from a polymer composition having a resistivity at 20° C. of at least $10^{13}$ Ω·cm. The polymer composition includes elastomers, thermoplastic elastomers and plastics. Preferably the polymer composition is based on silicone rubber.

The elongated fibres of the conductor core may be in direct contact with the high voltage coil terminal of the ignition coil and the electrode terminal of the resistor-type spark plug. The terminals connecting insert may be terminated for electrical contact with the high voltage coil terminal of the ignition coil and the electrode terminal of the resistor-type spark plug.

The detachable-insulator of the ignition coil assembly may be fabricated by molding of heat and chemical resistant polymer composition having a resistivity at 20° C. of at least $10^{13}$ Ω·cm. The polymer composition includes elastomers, thermoplastic elastomers and plastics. Preferably, the polymer composition is from elastomers such as silicone rubber. The detachable-insulator may include a composite structure having a tubular plastic body with both ends equipped with rubber connectors.

The terminals connecting insert may have both ends being installed with rubber connectors to seal and insulate the high voltage coil terminal of the ignition coil and the electrode terminal of the resistor-type spark plug respectively when the detachable-insulator is excluded from the ignition coil assembly.

An insulator may be non-detachable from the high voltage coil terminal of an ignition coil. The non-detachable-insulator forms an integral part of the ignition coil.

An ignition system of an internal combustion engine comprises an ignition coil assembly that supplies a high voltage electric current to a spark plug, which is preferably a resistor-type. In accordance with this invention, the ignition coil assembly includes: a terminals connecting insert that connects the high voltage coil terminal of an ignition coil to the electrode terminal of the resistor-type spark plug; a conductor core of the terminals connecting insert forms a layer of a plurality of elongated fibres of carbon fibre or graphite fibre extending side-by-side, and disposed at the innermost centre of the terminals connecting insert; a conductor supporting body stem of the terminals connecting insert forms an insulating and protecting layer around the outside of the fibre conductor core; and a non-detachable-insulator having an interior longitudinally extending passageway to house the high voltage coil terminal of the ignition coil, the terminals connecting insert and the electrode terminal of the resistor-type spark plug. The non-detachable-insulator forms a cylindrical housing to insulate the high voltage coil terminal of the ignition coil and the electrode terminal of the resistor-type spark plug.

The conductor core of the terminals connecting insert is in a form of elongated fibres of carbon fibre or graphite fibre being arranged in a bundle and disposed along the centre line of the terminals connecting insert. The elongated fibres of the conductor core are derived from fibres selected from a group consisting of carbonization of man-made fibres, and coal tar and petroleum pitch. The man-made fibres may include synthetic polymers such as homopolymer and or copolymer of polyacrylonitrile. The man-made fibres may include natural polymers and their derivatives, such as cellulose and rayon. Preferably the fibre conductor core is derived from the homopolymer and copolymer of polyacrylonitrile. The conductor core may include the elongated fibres without conductive coating. The plurality of elongated fibres may be coated with conductive composition having a resistivity of below 16 KΩ·m at 15° C., preferably below 5 KΩ·m at 15° C. The conductive composition may include synthetic latex, elastomers and thermoplastics. Preferably the conductive composition is based on synthetic latex. The terminals connecting insert has a resistance per unit length most preferably less than 50 Ω/m. The terminals connecting insert conducts the high voltage electric current from the high voltage coil terminal of the ignition coil to the electrode terminal of the resistor-type spark plug.

The terminals connecting insert includes a conductor supporting body stem. The conductor supporting body stem may include a retainer supporting body stem. The retainer supporting body stem acts as a retainer means of the terminals connecting insert. The terminals connecting insert is in a tubular form of the conductor supporting body stem having outside diameter in the range of 2 mm to 20 mm. The terminals connecting insert may include a retainer supporting body stem having a configuration being branched out from the conductor supporting body stem. The retainer supporting body stem of the terminals connecting insert may form an integral molded part with the conductor supporting body stem. The terminals connecting insert may include the component assembly of the retainer supporting body stem with the conductor supporting body stem. The terminals connecting insert may include a solid structure of the conductor supporting body stem. In this invention, the terminals connecting insert has a configuration design based on the functional design of the conductor supporting body stem and the retainer supporting body stem. The configuration design of the terminals connecting insert includes the shapes of a cone, rhombus, rectangle, cylindrical, square, triangle and their combinations, most preferably derived from the cone and its combination. The terminals connecting insert may have different shapes.

The retainer supporting body stem may have outside diameter in the range of 4 mm to 24 mm, which acts as a retainer means to keep the terminals connecting insert remaining in a stable position along the passageway of the non-detachable insulator during the installation and removal of the spark plug, and to uphold the centre line of terminals connecting insert in position adjacent the longitudinal centre lines of the non-detachable-insulator, high voltage coil terminal of the ignition coil and the electrode terminal of the resistor-type spark plug. The terminals connecting insert may include at least one and less than three retainer supporting body stem. The conductor supporting body stem and the retainer supporting body stem of the terminals connecting insert may be fabricated from a polymer composition having a resistivity at 20° C. of at least $10^{13}$ Ω·cm. The polymer composition may include elastomers, thermoplastic elastomers and plastics. Preferably the polymer composition is based on silicone rubber.

The elongated fibres of the conductor core may be in direct contact with the high voltage coil terminal of the ignition coil and the electrode terminal of the resistor-type spark plug. The terminals connecting insert may be terminated for electrical contact with the high voltage coil terminal of the ignition coil and the electrode terminal of the resistor-type spark plug.

The non-detachable-insulator is in an integral form of an insulator with the ignition coil. The non-detachable-insulator may be fabricated by molding of heat and chemical resistant polymer composition having a resistivity at 20° C. of at least $10^{13}$ Ω·cm. The polymer composition may include engineering plastics and thermosetting resins. The thermosetting resins include epoxy resin. The engineering plastics may include those being derived from polyester and polyamide. Preferably the polymer composition is based on engineering plastics such as polybutylene terephthalate. The non-detachable-insulator forms an integral part of the ignition coil. The non-detachable-insulator may include an outside layer of elastic sleeve being fabricated from an elastomeric composition to protect the non-detachable-insulator against dielectric leaking upon performance ageing. The elastomeric composition may include silicone rubber, fluoroelastomer, hydrogenated nitrile, acrylic rubber, and ethylene-propylene-diene terpolymer. Preferably the elastomeric composition is based on silicone rubber.

BRIEF OF THE DRAWINGS

Specific embodiments of the invention will now be described by way of example only and with reference to the accompanying drawings, in which:

FIG. 1. is a schematic view of an ignition system comprising an ignition coil assembly that embodies this invention of a terminals connecting insert as a replacement of conventional metallic coil spring.

Figure 2:
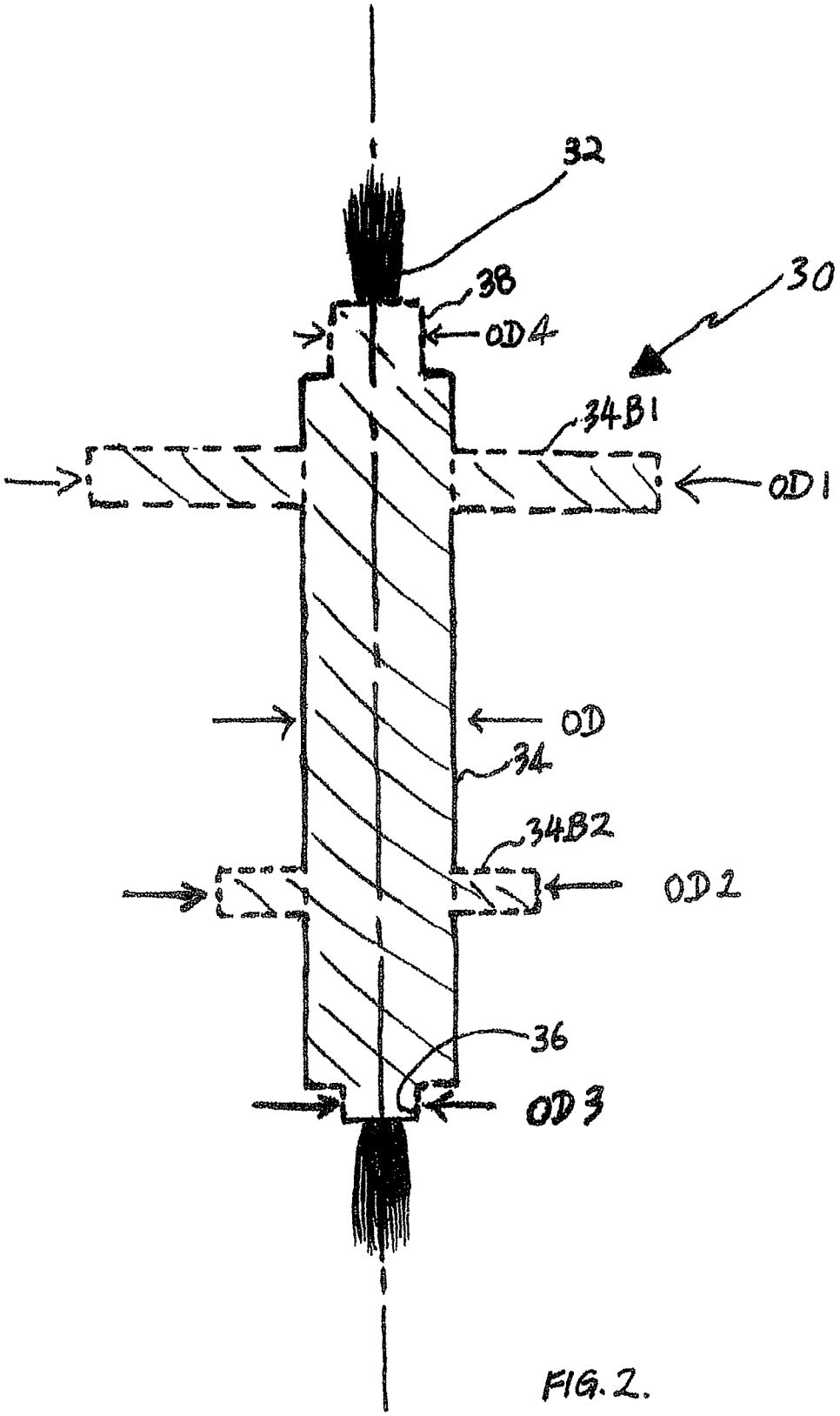

FIG. 2. is a diagrammatic view showing an exemplary of the composition and structural features of a terminals connecting insert in accordance of this invention.

Figure 3:
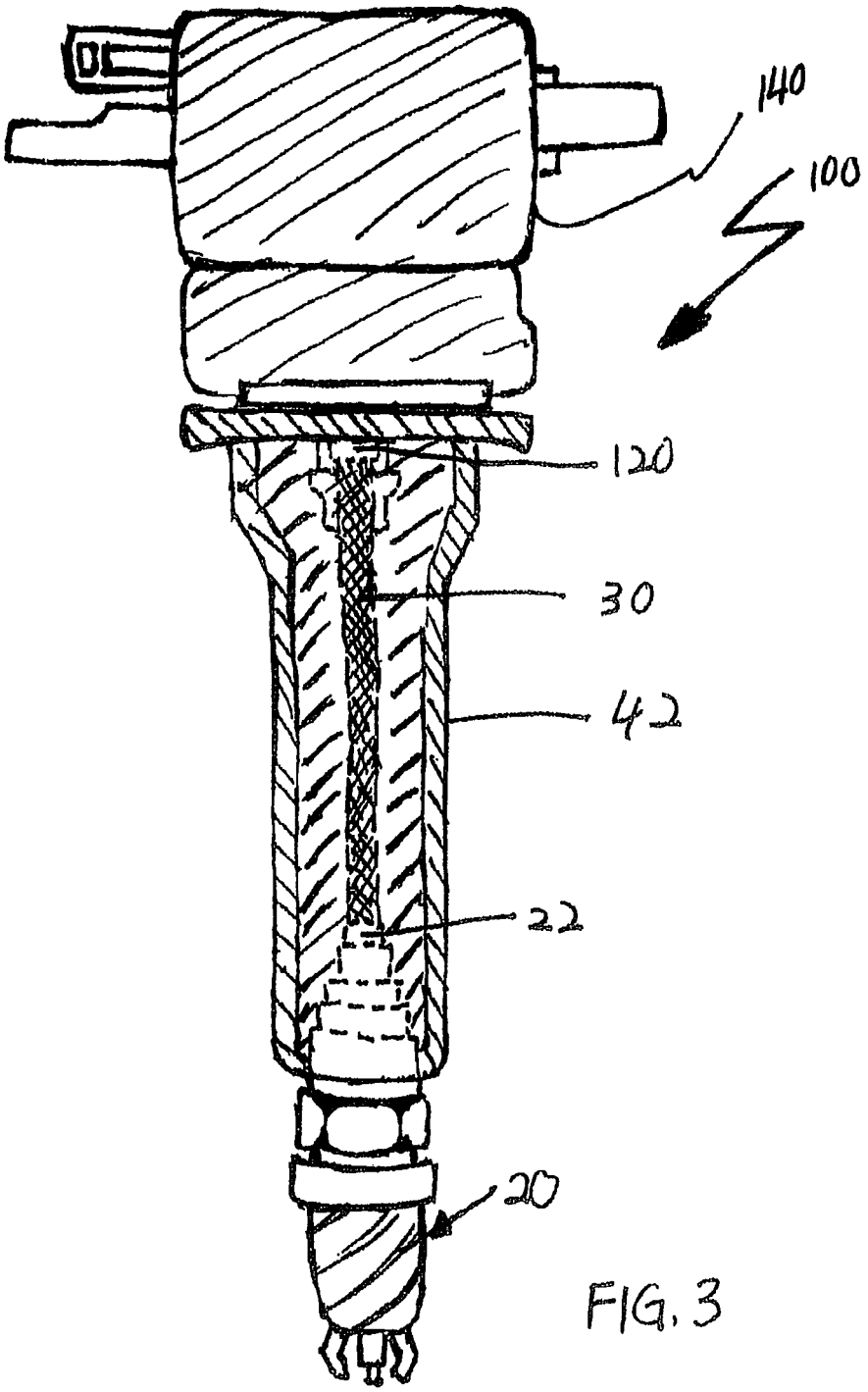

FIG. 3. illustrates an ignition system comprising an ignition coil assembly associated with a detachable-insulator that embodies this invention of a terminals connecting insert as a replacement of convention metallic coil spring.

Figure 4:
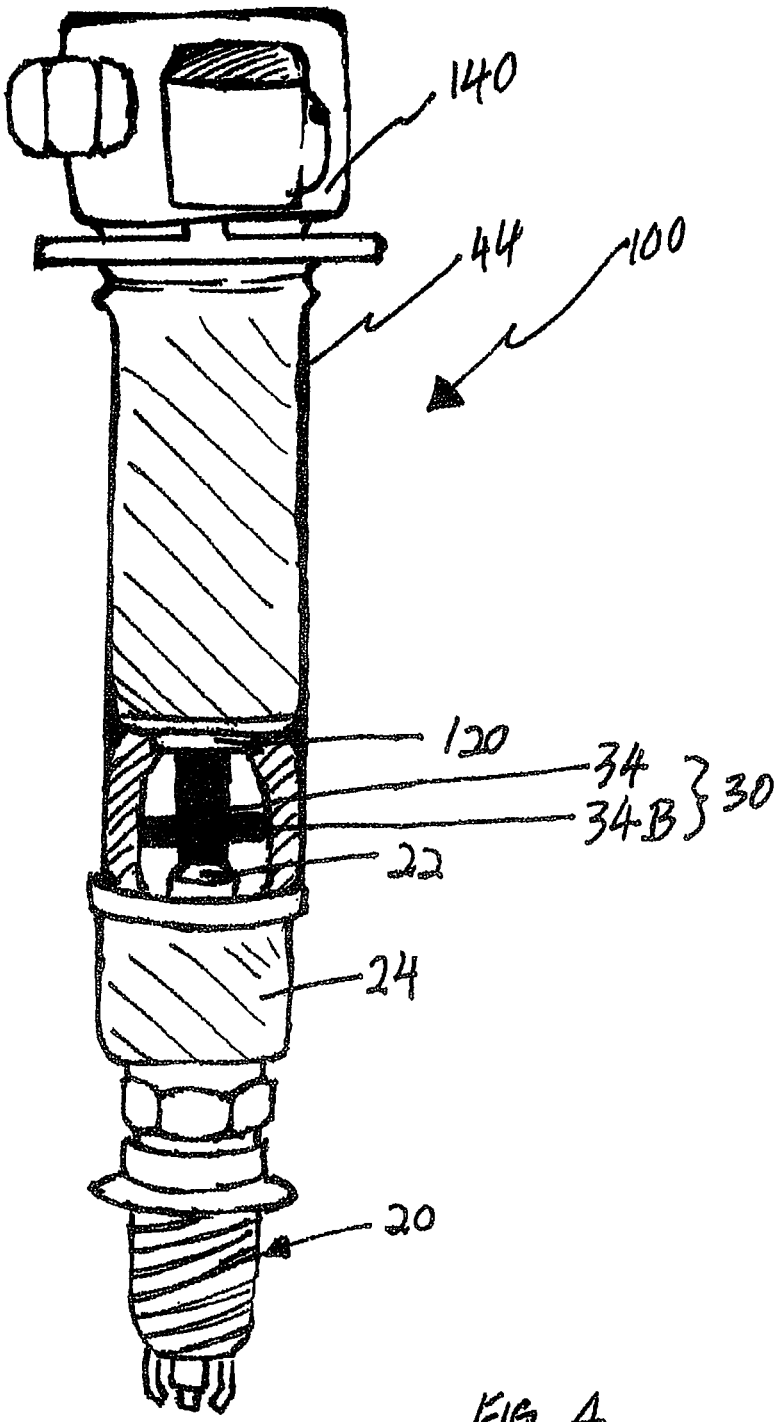

FIG. 4. shows an ignition system comprising a partial cross-sectional view of an ignition coil assembly associated with a non-detachable-insulator that embodies this invention of a terminals connecting insert as a replacement of conventional metallic coil spring.

DETAILED DESCRIPTION OF THE INVENTION

A traditional ignition system of an internal combustion engine comprises an ignition coil assembly that supplies a high voltage electric current to a spark plug, which is preferably a resistor-type. The ignition coil assembly includes an ignition coil which is mounted directly on each of the spark plug. The ignition coil has a primary coil and a secondary coil which are magnetically coupled, low voltage current is switched through the primary coil, and inducing higher voltage current in the secondary coil. The ignition coil assembly includes a conventional metallic coil spring type conductor to conduct the high voltage electric current from the high voltage coil terminal of the ignition coil to the electrode terminal of the spark plug, and the high voltage electric current discharges an air gap in the spark plug, creating a spark energy to ignite the fuel-air mixture inside the combustion chamber of an internal combustion engine.

FIG. 1. is a schematic view of an ignition system comprising an ignition coil assembly that embodies this invention of a terminals connecting insert as a replacement of conventional metallic coil spring. An ignition system of an internal combustion engine has at least one ignition coil assembly. The required number of ignition coil assembly depends on the automobile engine output, for example, a small motorcycle engine may have one ignition coil assembly, and a high output car engine may have eight ignition coil assembly. A typical four cylinders engine has four ignition coil assembly. Each of the ignition coil assembly (100) in the ignition system is similar to each other ignition coil assembly (100). Only one of the ignition coil assembly (100) will therefore be described in detail. An ignition system comprises an ignition coil assembly (100) that supplies a high voltage electric current to a spark plug (20), which is preferably a resistor-type. The ignition coil assembly (100) includes an ignition coil (140), the high voltage coil terminal (120) of the ignition coil, a terminals connecting insert (30) and an insulator (40). The induced high voltage electric current from the ignition coil (140) is being accumulated and distributed through the high voltage coil terminal (120) which connects to the secondary coil of the ignition coil. The terminals connecting insert (30) connects the high voltage coil terminal (120) of the ignition coil (140) to the electrode terminal (22) of the resistor-type spark plug (20). The terminals connecting insert (30) acts as a device to conduct the high voltage electric current from the high voltage coil terminal (120) of the ignition coil to the resistor-type spark plug (20), and the high voltage electric current discharges an air gap in the spark plug, creating a spark energy to ignite the fuel-air mixture inside the combustion chamber (50) of an internal combustion engine. The terminals connecting insert (30) is adapted to replace conventional metallic coil spring as an electrical device to conduct the high voltage electric current. The terminals connecting insert (30) has a conductor core formed with a plurality of elongated fibres of carbon fibre or graphite fibre extending side-by-side (not shown in FIG. 1) and disposed at the innermost centre of the terminals connecting insert. The terminals connecting insert (30) includes a conductor supporting body stem (34). The conductor supporting body stem (34) may include retainer supporting body stem (34B) having a configuration being branched out from the conductor supporting body stem (34). An exemplary of composition and structural features of the terminals connecting insert is shown in FIG. 2. With the continuation of FIG. 1, an insulator (40) provides an interior longitudinally extending passageway to house the high voltage coil terminal (120) of the ignition coil (140), the terminals connecting insert (30), the electrode terminal (22) of the resistor-type spark plug (20), and portion of the spark plug (20). The insulator (40) forms a cylindrical housing to insulate the high voltage coil terminal (120) and the electrode terminal (22).

The insulator (40) may be detachable from the high voltage coil terminal (120) of the ignition coil (140). The detachable-insulator (42) may form a separate component which is detachable from the ignition coil (140). The detachable-insulator (42) may include a solid structural component being fabricated from elastomeric composition. The detachable-insulator (42) may include a composite structure having a tubular plastic body with both ends equipped with rubber connector.

The insulator (40) may not be separated from the ignition coil (140). The non-detachable-insulator (44) forms an integral part of the ignition coil (140), and cannot be detached from the high voltage coil terminal (120) of the ignition coil (140). The non-detachable-insulator (44) may be fabricated from engineering plastics and thermosetting resins.

FIG. 2. is a diagrammatic view showing an exemplary of the composition and structural features of a terminals connecting insert in accordance of this invention. Further to the description of FIG. 1., an ignition coil assembly embodies this invention of a terminals connecting insert (30) as a replacement of conventional metallic coil spring, and the terminals connecting insert (30) connects the high voltage coil terminal of the ignition coil to the electrode terminal of a spark plug. The terminals connecting insert (30) conducts the high voltage electric current from the high voltage coil terminal (120) to the electrode terminal (22). The design of the terminals connecting insert (30) depends on the configuration of the insulator (40) and the high voltage coil terminal (120). The terminals connecting insert (30) has a conductor core (32) formed with a plurality of elongated fibres of carbon fibre or graphite fibre extending side-by-side, arranged in a bundle and disposed along the centre line of the terminals connecting insert (30). The elongated fibres of the conductor core (32) are disposed at the innermost centre of the terminals connecting insert (30). The elongated fibres of the conductor core (32) are derived from fibres selected from a group consisting of carbonization of man-made fibres, and coal tar and petroleum pitch. The man-made fibres may include synthetic polymers such as homopolymer and or copolymer of polyacrylonitrile. The man-made fibres may include natural polymers and their derivatives, such as cellulose and rayon. Preferably the fibre conductor core (32) is derived from homopolymers and or copolymer of polyacrylonitrile. The conductor core (32) may include the elongated fibres without conductive coating. The conductor core (32) is arranged to have a low electrical resistance per unit length preferably less than 50 Ω/m. The plurality of the elongated fibres may be coated with conductive composition having a resistivity of below 16 KΩ·m. at 15° C., preferably below 5 KΩ·m The conductive composition may include synthetic latex, elastomers and thermoplastics. Preferably the conductive composition is based on synthetic latex.

The terminals connecting insert (30) includes a conductor core supporting body stem (34), which forms an insulating and protecting layer around the outside of the innermost fibre conductor core (32). The conductor supporting body stem (34) may include retainer supporting body stem (34B) having a configuration being branched out from the conductor supporting body stem (34). The retainer supporting body stem acts as a retainer means for the proper positioning of the terminals connecting insert (30) inside the insulator (40) of the ignition coil assembly (100). The terminals connecting insert (30) may exclude the retainer supporting body stem (34B). FIG. 2. shows an exemplary of the composition and structural features of a terminals connecting insert. The conductor supporting body stem (34) of the terminals connecting insert (30) is in a tubular form having outside diameter OD in the range of 2 mm to 20 mm. The conductor supporting body stem (34) may have either one end (36) or (38) with a design of reduced outside diameter OD3 and OD 4 respectively. The conductor supporting body stem (34) may have both ends (36) and (38) with a design of reduced outside diameter OD3 and OD4 respectively. The terminals connecting insert (30) may include retainer supporting body stem (34B1) and or (34B2) having a configuration being branched out from the conductor supporting body stem (34). The retainer supporting body stem (34B1) and or (34B2) of the terminals connecting insert (30) may form an integral molded part with the conductor supporting body stem (34). The retainer supporting body stem (34B1) and or (34B2) may have outside diameter OD1 and or OD2 respectively in the range of 4 mm to 24 mm, which acts as a retainer means to keep the terminals connecting insert (30) remaining in a stable position along the passageway of the insulator (40) during the installation and removal of the resistor-type spark plug (20), and to uphold the centre line of terminals connecting insert (30) in position adjacent the longitudinal centre lines of the insulator (40), the high voltage coil terminal (120) of the ignition coil (140), and the electrode terminal (22) of the resistor-type spark plug (20). The terminals connecting insert (30) may include the component assembly of the conductor supporting body stem (34) with the retainer supporting body stem (34B1) and or (34B2). The terminals connecting insert (30) may include a solid structure of the conductor supporting body stem (34). The terminals connecting insert (30) may include at least one and less than three retainer supporting body stem. The terminals connecting insert (30) may have one retainer supporting body stem (34B1) or (34B2). The terminals connecting insert (30) may have two retainer supporting body stems (34B1) and (34B2). In extreme case, the terminals connecting insert (30) may have three retainer supporting body stems. Depending on the configuration of the high voltage coil terminal (120) and insulator (40) of the ignition coil assembly (100), the terminals connecting insert (30) may be designed without the incorporation of a retainer supporting body stem, and the terminals connecting insert (30) is in a tubular form of the conductor supporting body stem (34). The configuration design of the terminals connecting insert (30) depends on the configuration of the high voltage coil terminal (120) of the ignition coil (140) and the insulator (40). In this invention, the terminals connecting insert (30) has a configuration design based on the functional design of the conductor supporting body stem (34) and the retainer supporting body stem (34B). The configuration design of the terminals connecting insert (30) includes the shapes of a cone, rhombus, rectangle, cylindrical, square, triangle and their combinations, most preferably derived from the cone shape and its combination. The terminals connecting insert (30) may have different shapes.

The conductor supporting body stem (34) and the retainer supporting body stem (34B1) and or (34B2) of the terminals connecting insert (30) may be fabricated from a polymer composition having a resistivity at 20° C. of at least $10^{13}$ Ω·cm., which has good insulating property and resistant to both the heat and chemicals. The polymer composition may include elastomers, thermoplastic elastomers and thermoplastics, and more preferably elastomers. Elastomers may includes silicone rubber, hydrogenated nitrile, ethylene-propylene-diene-terpolymer, butyl rubber, fluoroelastomer and acrylic rubber. Preferably the polymer composition is based on silicone rubber. Silicone rubber has excellent dielectric property, and resistance to heat and compression.

The elongated fibres of the conductor core (32) may be in direct contact with the high voltage coil terminal (120) of the ignition coil (140) and the electrode terminal (22) of the resistor-type spark plug (20). The terminals connecting insert (30) may be terminated for electrical contact with the high voltage coil terminal (120) of the ignition coil (140) and the electrode terminal (22) of the resistor-type spark plug (20). Either one or both ends of the terminals connecting insert (30) may require crimping of terminals.

FIG. 3. illustrates an ignition system comprising an ignition coil assembly associated with a detachable-insulator that embodies this invention of a terminals connecting insert as a replacement of convention metallic coil spring. An ignition system comprises an ignition coil assembly (100) that supplies a high voltage electric current to a spark plug (20) which is preferably a resistor-type. In accordance of this invention, the ignition coil assembly (100) includes an ignition coil (140), a high voltage coil terminal (120), a terminals connecting insert (30) and a detachable-insulator (42). With continued references to FIG. 1 and FIG. 2, the ignition coil assembly (100) includes: a terminals connecting insert (30) that connects the high voltage coil terminal (120) of an ignition coil (140) to the electrode terminal (22) of the resistor-type spark plug (20); a conductor core (32) of the terminals connecting insert comprises a layer of a plurality of elongated fibres of carbon fibre or graphite fibre extending side-by-side (not shown in FIG. 3) and disposed at the innermost centre of the terminals connecting insert (30); a conductor supporting body stem (34) of the terminals connecting insert (30) forms an insulating and protecting layer around the outside of the fibre conductor core (32); and a detachable-insulator (42) having an interior longitudinally extending passageway to house the high voltage coil terminal (120) of the ignition coil (140), the terminals connecting insert (30) and the electrode terminal (22) of the resistor-type spark plug (20). The detachable-insulator (42) forms a cylindrical housing to insulate the high voltage coil terminal (120) of the ignition coil (140) and the electrode terminal (22) of the resistor-type spark plug (20). The induced high voltage electric current from the ignition coil (140) is being accumulated and distributed through a high voltage coil terminal (120) which connects to the secondary coil of the ignition coil. The terminals connecting insert (30) acts as a device to conduct the high voltage electric current from the high voltage coil terminal (120) to the electrode terminal (22), and the high voltage electric current discharges an air gap in the spark plug, creating a spark energy to ignite the fuel-air mixture inside the combustion chamber of an internal combustion engine.

The terminals connecting insert (30) is adapted to replace conventional metallic coil spring as an electrical device to conduct the high voltage electric current. The terminals connecting insert (30) includes a conductor core (32) having a plurality of elongated fibres of carbon fibre or graphite fibre arranged in a bundle, and disposed along the centre line of the terminals connecting insert (30). The elongated fibres of the conductor core (32) are derived from fibres selected from a group consisting of carbonization of man-made fibres, and coal tar and petroleum pitch. The fibre conductor core (32) of the terminals connecting insert (30) is arranged to have a low electrical resistance per unit length preferably less than 50 Ω/m. The conductor core may include the elongated fibres without conductive coating. The plurality of the elongated fibres may be coated with conductive composition having a resistivity of below 16 KΩ·m at 15° C., preferably below 5 KΩ·m. The conductive composition may include synthetic latex, elastomers and thermoplastics. Preferably the conductive composition is based on synthetic latex. The terminals connecting insert (30) conducts the high voltage electric current from the high voltage coil terminal (120) of the ignition coil (140) to the electrode terminal (22) of the spark plug (20).

The terminals connecting insert (30) may be in a tubular form of the conductor supporting body stem (34) having outside diameter in the range of 2 mm to 20 mm. The terminals connecting insert (30) may include retainer supporting body stem (34B), as an exemplary shown in FIG. 1, having a configuration being branched out from the conductor supporting body stem (34). The retainer supporting body stem (34B) acts as a retainer means, having outside diameter in the range of 4 mm to 24 mm, that to keep the terminals connecting insert (30) remaining in a stable position along the passageway of the detachable-insulator (42) during the installation and removal of the resistor-type spark plug (20), and to uphold the centre line of terminals connecting insert (30) in position adjacent the longitudinal centre lines of the detachable-insulator (42), the high voltage coil terminal (120) of the ignition coil (140) and the electrode terminal (22) of the resistor-type spark plug (20).

The terminals connecting insert (30) may include the component assembly of the conductor supporting body stem (34) with the retainer supporting body stem (34B1) and or (34B2), as an exemplary shown in FIG. 2. The retainer supporting body may form an integral molded part with the conductor supporting body stem (34). The terminals connecting insert (30) may include a solid structure of the conductor supporting body stem (34). The terminals connecting insert (30) may include at least one and less than three retainer supporting body stem. The terminals connecting insert (30) may have one retainer supporting body stem (34B1) or (34B2). The terminals connecting insert (30) may have two retainer supporting body stems (34B1) and (34B2). In extreme case, the terminals connecting insert (30) may have three retainer supporting body stems. Depending on the configuration of the high voltage coil terminal (120) and the detachable-insulator (42) of the ignition coil assembly (100), the terminals connecting insert (30) may be designed without the incorporation of a retainer supporting body stem, as an exemplary shown in FIG. 3, and the terminals connecting insert (30) is in a tubular form of the conductor supporting body stem (34). The configuration design of the terminals connecting insert (30) depends on the configuration of the high voltage coil terminal (120) and the detachable-insulator (42) of the ignition coil assembly (100). In this invention, the terminals connecting insert (30) has a configuration design based on the functional design of the conductor supporting body stem and the retainer supporting body stem. The configuration design of the terminals connecting insert includes the shapes of a cone, rhombus, rectangle, cylindrical, square, triangle and their combinations, most preferably derived from the cone shape and its combination. The terminals connecting insert (30) may have different shapes.

The conductor supporting body stem and the retainer supporting body stem of the terminals connecting insert (30) may be fabricated from a polymer composition having a resistivity at 20° C. of at least $10^{13}$ Ω·cm. The polymer composition includes elastomers, thermoplastic elastomers and thermoplastics. Any one of the following elastomers may be used: hydrogenated nitrile, acrylic rubber, and ethylene-propylene-diene-terpolymer, butyl rubber, fluoroelastomer and silicone rubber. Preferably the polymer composition is based on silicone rubber. Silicone rubber has excellent dielectric property, and resistance to heat, chemicals and compression.

The elongated fibres of the conductor core (32) may be in direct contact with the high voltage coil terminal (120) of the ignition coil (140) and the electrode terminal (22) of the resistor-type spark plug (20). The terminals connecting insert (30) may be terminated for electrical contact with the high voltage coil terminal (120) of the ignition coil (140) and the electrode terminal (22) of the resistor-type spark plug (20). Either one or both ends of the terminals connecting insert (30) may require crimping of terminals.

The detachable insulator (42) forms a cylindrical housing to insulate the high voltage coil terminal (120) of the ignition coil (140), the terminals connecting insert (30), the electrode terminal (22) of the spark plug (20) and portion of the spark plug (20). The detachable-insulator (42) is fabricated from heat and chemical resistant polymer composition having a resistivity at 20° C. of at least $10^{13}$ Ω·cm. Any one of the following polymer composition may be used: elastomers, thermoplastic elastomers and plastics. Preferably the polymer composition is based on elastomers. The detachable-insulator (42) may include a composite structure having a hollow plastic body with both ends equipped with rubber connectors. The rubber connectors act as a joint seal for better insulation of the high voltage coil terminal (120) and the electrode terminal (22). The detachable-insulator (42) may include a solid structural component based on elastomeric composition, which may reduce the risk of dielectric leaking of the plastic body after performance ageing. Elastomers may include silicone rubber, hydrogenated nitrile, acrylic rubber, fluoroelastomer, butyl rubber and ethylene-propylene-diene terpolymer. Preferably the detachable-insulator (42) is formed from silicone rubber. Silicone rubber provides proper sealing and insulation for the high voltage coil terminal (120) of the ignition coil (140), the electrode terminal (22) of the resistor-type spark plug (20) and portion of the spark plug (20).

The ignition coil assembly (100) may exclude the detachable-insulator (42) when the terminals connecting insert (30) have both ends being installed with rubber connectors to seal and insulate the high voltage coil terminal (120) of the ignition coil (140) and the electrode terminal (22) of the resistor-type spark plug (20)

Exemplary embodiments of this invention include the use of a terminals connecting insert (30) as a replacement of conventional metallic coil spring for an ignition coil assembly (100) associated with a detachable-insulator (42), including:

The first embodiment is based on the terminals connecting insert (30) having a resistance per unit length of less than 50 Ω/m., and in a tubular form of a conductor supporting body stem (34) being fabricated from silicone rubber composition.

The second embodiment is based on the terminals connecting insert (30) having a resistance per unit length of less than 50 Ω/m., and including a conductor supporting body stem (34) and one retainer supporting body stem (34B1) or (34B2) being fabricated from silicone rubber composition.

The third embodiment is based on the terminals connecting insert (30) having a resistance per unit length of less than 50 Ω/m., and including a conductor supporting body stem (34) and two retainer supporting body stems (34B1) and (34B2) being fabricated from silicone rubber composition.

The fourth embodiment is based on the terminals connecting insert (30) having a resistance per unit length of less than 50 Ω/m., and including a conductor supporting body stem (34) and one retainer supporting body stem (34B1) or (34B2); with one end (36) or (38) of the conductor supporting body stem (34) having a reduced outside diameter; and the conductor supporting body stem and retainer supporting body stem being fabricated from silicone rubber composition.

The fifth embodiment is based on the terminals connecting insert (30) having a resistance per unit length of less than 50 Ω/m., and including a conductor supporting body stem (34) and one retainer supporting body stem (34B1) or (34B2); and both ends (36) and (38) of the conductor supporting body stem (34) having reduced outside diameter; and the conductor supporting body stem and retainer supporting body stem being fabricated from silicone rubber composition.

The above mentioned embodiments are using a detachable-insulator (42) being fabricated from silicone rubber composition. The chosen silicone rubber composition provides proper sealing and insulation for the high voltage coil terminal (120) of the ignition coil (140), the electrode terminal (22) of the resistor-type spark plug (20) and portion of the spark plug (20).

The sixth embodiment has similar arrangement based on the first embodiment, and in addition, the terminals connecting insert (30) having both ends being installed with rubber connectors to seal and insulate the high voltage coil terminal (120) of the ignition coil (140) and the electrode terminal (22) of the resistor-type spark plug (20) respectively when the detachable-insulator (42) is excluded as a component part of the ignition coil assembly (100).

The above embodiments show that the terminals connecting insert (30) may have different shapes.

FIG. 4. shows an ignition system comprising a partial cross-sectional view of an ignition coil assembly associated with a non-detachable-insulator that embodies this invention of a terminals connecting insert as a replacement of conventional metallic coil spring. An ignition system comprises an ignition coil assembly (100) that supplies a high voltage electric current to a spark plug (20) which is preferably a resistor-type. In accordance of this invention, the ignition coil assembly (100) includes an ignition coil (140), a high voltage coil terminal (120), a terminals connecting insert (30) and a non-detachable-insulator (44). With continued reference to FIG. 1 and FIG. 2, the ignition coil assembly (100) includes: a terminals connecting insert (30) that connects the high voltage coil terminal (120) of an ignition coil (140) to the electrode terminal (22) of the resistor-type spark plug (20); a conductor core (32) of the terminals connecting insert (30) comprises a layer of a plurality of elongated fibres of carbon fibre or graphite fibre extending side-by-side (not shown in FIG. 4) and disposed at the innermost centre of the terminals connecting insert (30); a conductor supporting body stem (34) of the terminals connecting insert (30) forms an insulating and protecting layer around the outside of the fibre conductor core (32); and a non-detachable-insulator (44) having an interior longitudinally extending passageway to house the high voltage coil terminal (120) of the ignition coil (140), the terminals connecting insert (30) and the electrode terminal (22) of the resistor-type spark plug (20). The non-detachable-insulator (44) forms a cylindrical housing to insulate the high voltage coil terminal (120) of the ignition coil (140) and the electrode terminal (22) of the resistor-type spark plug (20).

The induced high voltage electric current from the ignition coil (140) is being accumulated and distributed through the high voltage coil terminal (120) which connects to the secondary coil of the ignition coil. The terminals connecting insert (30) acts as a device to conduct the high voltage current from the high voltage coil terminal (120) to the electrode terminal (22), and the high voltage electric current discharges an air gap in the spark plug, creating a spark energy to ignite the fuel-air mixture inside the internal combustion engine.

The terminals connecting insert (30) is adapted to replace conventional metallic coil spring as an electrical device to conduct the high voltage electric current. The terminals connecting insert (30) includes a conductor core (32) having a plurality of elongated fibres of carbon fibre or graphite fibre arranged in a bundle and disposed along the centre line of the terminals connecting insert (30). The elongated fibres of the conductor core (32) are derived from fibres selected from a group consisting of carbonization of man-made fibres, and coal tar and petroleum pitch. The fibre conductor core (32) of the terminals connecting insert (30) is arranged to have a low electrical resistance per unit length preferably less than 50 Ω/m. The conductor core may include the elongated fibres without conductive coating. The plurality of the elongated fibres may be coated with conductive composition having a resistivity of below 16 KΩ·m at 15° C., preferably below 5 KΩ·m. The conductive composition may include synthetic latex, elastomers and thermoplastics. Preferably the conductive composition is based on synthetic latex. The terminals connecting insert (30) conducts the high voltage electric current from the high voltage coil terminal (120) of the ignition coil (140) to the electrode terminal (22) of the spark plug (20).

The terminals connecting insert may be in a tubular form of the conductor supporting body stem (34) having outside diameter in the range of 2 mm to 20 mm. The terminals connecting insert (30) may include retainer supporting body stem (34B) having a configuration being branched out from the conductor supporting body stem (34). The retainer supporting body stem (34B) acts as a retainer means, having outside diameter in the range of 4 mm to 24 mm, that to keep the terminals connecting insert (30) remaining in a stable position along the passageway of the non-detachable-insulator (44) during the installation and removal of the resistor-type spark plug (20), and to uphold the centre line of terminals connecting insert (30) in position adjacent the longitudinal centre lines of the non-detachable-insulator (44), the high voltage coil terminal (120) of the ignition coil (140) and the electrode terminal (22) of the resistor-type spark plug (20).

The terminals connecting insert (30) may include the component assembly of the conductor supporting body stem (34) with the retainer supporting body stem (34B). The retainer supporting body stem (34B) may form an integral molded part with the conductor supporting body stem (34). The terminals connecting insert (30) may include a solid structure of the conductor supporting body stem (34). The terminals connecting insert (30) may include at least one and less than three retainer supporting body stem. The terminals connecting insert (30) may have one retainer supporting stem (34B), as an exemplary shown in FIG. 1 and FIG. 4. The terminals connecting insert (30) may have two retainer supporting body stems (34B1) and (34B2), as an exemplary shown in FIG. 2. In extreme case, the terminals connecting insert (30) may have three retainer supporting body stems. Depending on the configuration of the high voltage coil terminal (120) and the non-detachable-insulator (44) of the ignition coil assembly (100), the terminals connecting insert (30) may be designed without the incorporation of a retainer supporting body stem, and the terminals connecting insert (30) is in a tubular form of the conductor supporting body stem (34). The configuration design of the terminals connecting insert (30) depends on the configuration of the high voltage coil terminal (120) of the ignition coil (140) and the non-detachable-insulator (44). In this invention, the terminals connecting insert (30) has a configuration design based on the functional design of the conductor supporting body stem and the retainer supporting body stem. The configuration design of the terminals connecting insert (30) includes the shapes of a cone, rhombus, rectangle, cylindrical, square, triangle and their combinations. Most preferably the shape is derived from the cone shape and its combination. The terminals connecting insert (30) may have different shapes.

The conductor supporting body stem (34) and the retainer supporting body stem (34B) of the terminals connecting insert (30) may be fabricated from a polymer composition having a resistivity at 20° C. of at least $10^{13}$ Ω·cm. The polymer composition includes elastomers, thermoplastic elastomers and thermoplastics. Any one of the following elastomers may be used: hydrogenated nitrile, acrylic rubber, and ethylene-propylene-diene-terpolymer, butyl rubber, fluoroelastomer and silicone rubber. Preferably the polymer composition is based on silicone rubber. Silicone rubber has excellent dielectric property, and resistance to heat, chemicals and compression.

The elongated fibres of the conductor core (32) may be in direct contact with the high voltage coil terminal (120) of the ignition coil (140) and the electrode terminal (22) of the resistor-type spark plug (20). The terminals connecting insert (30) may be terminated for electrical contact with the high voltage coil terminal (120) of the ignition coil (140) and the electrode terminal (22) of the resistor-type spark plug (20). Either one or both ends of the terminals connecting insert (30) may require crimping of terminals.

The non-detachable-insulator (44) provides an interior longitudinally extending passageway to house the high voltage coil terminal (120), the terminals connecting insert (30), the electrode terminal (22) of the resistor-type spark plug (20), and portion of the spark plug (20). The non-detachable-insulator (44) forms an integral part of the ignition coil (140). The non-detachable-insulator (44) may be fabricated from heat and chemical resistant polymer composition derived from engineering plastics and thermosetting resins having a resistivity at 20° C. of at least $10^{13}$ Ω·cm. The engineering plastics may include those being derived from polyester and polyamide. The thermosetting resins may include epoxy resin. Preferably the non-detachable-insulator (44) is fabricated from the engineering plastics such as polybutylene terephthalate. Exemplary embodiments of this invention uses the non-detachable-insulator (44) based on polybutylene terephthalate, and a rubber boot connector (24) is required to provide sealing and electrical insulation for the joint connection in between the plastic non-detachable-insulator (44) and the spark plug (20). Polybutylene terephthalate has excellent heat and dielectric property.

The non-detachable-insulator (44) may include an outside layer of elastic sleeve being fabricated from an elastomeric composition to protect the non-detachable-insulator (44) against dielectric leaking upon performance ageing. Preferably the elastomeric composition is based on silicone rubber.

Exemplary embodiments of this invention include the use of a terminals connecting insert (30) as a replacement of conventional metallic coil spring for an ignition coil assembly (100) associated with a non-detachable-insulator (44), including:

The seventh embodiment is based on the terminals connecting insert (30) having a resistance per unit length of less than 50 Ω/m., and in a tubular form of a conductor supporting body stem (34) being fabricated from silicone rubber composition.

The eighth embodiment is based on the terminals connecting insert (30) having a resistance per unit length of less than 50 Ω/m., and including a conductor supporting body stem (34) and one retainer supporting body stem (34B) being fabricated from silicone rubber composition.

The ninth embodiment is based on the terminals connecting insert (30) having a resistance per unit length of less than 50 Ω/m., and including a conductor supporting body stem (34) and two retainer supporting body stems (34B1) and (34B2) being fabricated from silicone rubber composition.

The tenth embodiment is based on the terminals connecting insert (30) having a resistance per unit length of less than 50 Ω/m., and including a conductor supporting body stem (34) and one retainer supporting body stem (34B); with one end (36) or (38) of the conductor supporting body stem (34) having a reduced outside diameter; and the conductor supporting body stem and the retainer supporting body stem of the terminals connecting insert (30) being fabricated from silicone rubber composition.

The eleventh embodiment is based on the terminals connecting insert (30) having a resistance per unit length of less than 50 Ω/m., and including a conductor supporting body stem (34) and one retainer supporting body stem (34B); and both ends (36) and (38) of the conductor supporting body stem (34) having reduced outside diameters; and the conductor supporting body stem and retainer supporting body stem of the terminals connecting insert (30) being fabricated from silicone rubber composition.

The above mentioned embodiments are using a non-detachable-insulator (44) being fabricated from polybutylene terephthalate.

The twelfth embodiment has similar arrangement based on the seventh embodiment, and in addition, the non-detachable-insulator (44) includes an outside layer of elastic sleeve (not shown in FIG. 4) being fabricated from an elastomeric composition to protect the non-detachable-insulator against dielectric leaking upon performance ageing. Preferably the elastomeric composition is based on silicone rubber.

Conventional ignition coil assembly includes a metallic coil spring to conduct the high voltage electric current from the high voltage coil terminal of the ignition coil to the electrode terminal of the spark plug. The metallic coil spring may induce misfire problem associated with its inconsistent electrical conductivity due to its inferior corrosion resistance after performance ageing under the harsh under-hood working environment. This may lead to a gradual increase in fuel consumption and loss of vehicle power. The other drawback of the metallic coil spring includes the possibility of dielectric failure due to the induction of electro-magnetic field concentration. These drawbacks can be overcome by the embodiments of this invention including the use of a terminals connecting insert as a replacement of conventional metallic coil spring. The conductor core of the terminals connecting insert has excellent resistance to heat, corrosion and chemicals.

The invention claimed is:

1. An ignition system, comprising:

an ignition coil assembly that supplies a high voltage electric current to a resistor-type spark plug, and the ignition coil assembly that includes:

a terminals connecting insert connects a high voltage coil terminal of an ignition coil to an electrode terminal of the resistor-type spark plug;

a conductor core of the terminals connecting insert includes a layer of a plurality of elongated fibres of non-metallic carbon fibre or graphite fibre extending side-by-side, and disposed at an innermost centre of the terminals connecting insert;

a conductor supporting body stem of the terminals connecting insert forms an insulating and protecting layer around an outside of the conductor core; and a detachable-insulator having an interior longitudinally extending passageway to house the high voltage coil terminal of the ignition coil, the terminals connecting insert and the electrode terminal of the resistor-type spark plug.

2. The ignition coil assembly according to claim 1, wherein the elongated fibres of the conductor core are arranged in a bundle, and disposed along the centre line of the terminals connecting insert.

3. The ignition coil assembly according to claim 1, wherein the elongated fibres of the conductor core are derived from fibres selected from a group consisting of carbonization of man-made fibres, and coal tar and petroleum pitch.

4. The ignition coil assembly according to claim 1, wherein the elongated fibres being coated with conductive composition having a resistivity of below 16 KΩ·m at 15° C., preferably the conductive composition is based on synthetic latex having a resistivity of below 5 KΩ·m.

5. The ignition coil assembly according to claim 1, wherein the terminals connecting insert has a resistance per unit length preferably less than 50 Ω/m., to conduct the high voltage electric current from the high voltage coil terminal to the electrode terminal.

6. The ignition coil assembly according to claim 1, wherein the terminals connecting insert is in a tubular form of the conductor supporting body stem having outside diameter in the range of 2 mm to 20 mm.

7. The ignition coil assembly according to claim 1, wherein the terminals connecting insert includes a retainer supporting body stem having a configuration being branched out from the conductor supporting body stem.

8. The ignition coil assembly according to claim 7, wherein the terminals connecting insert includes the retainer supporting body stem forming an integral molded part with the conductor supporting body stem.

9. The ignition coil assembly according to claim 7, wherein the terminals connecting insert includes a component assembly of the retainer supporting body stem with the conductor supporting body stem.

10. The ignition coil assembly according to claim 7, wherein the retainer supporting body stem having outside diameter in the range of 4 mm to 24 mm, that acts as a retainer means to keep the terminals connecting insert remaining in a stable position along the passageway of the detachable-insulator during the installation and removal of the resistor-type spark plug, and to uphold the centre line of terminals connecting insert in position adjacent the longitudinal centre lines of the detachable-insulator, the high voltage coil terminal and the electrode terminal.

11. The ignition coil assembly according to claim 7, wherein the terminals connecting insert has a configuration design based on the functional design of the conductor supporting body stem and the retainer supporting body stem.

12. The ignition coil assembly according to claim 7, wherein configuration design of the terminals connecting insert includes the shapes of a cone, rhombus, rectangle, cylindrical, square, triangle and their combinations, preferably derived from the cone shape and its combination.

13. The ignition coil assembly according to claim 7, wherein the terminals connecting insert includes at least one and less than three retainer supporting body stem.

14. The ignition coil assembly or the terminals connecting insert according to claim 1, wherein the conductor supporting body stem and the retainer supporting body stem being fabricated from a polymer composition having a resistivity at 20° C. of at least $10^{13}$ Ω·cm., preferably the polymer composition is based on silicone rubber.

15. The ignition coil assembly according to claim 1, wherein the elongated fibres of the conductor core are in direct contact with the high voltage coil terminal and the electrode terminal.

16. The ignition coil assembly according to claim 1, wherein the terminals connecting insert is terminated for electrical contact with the high voltage coil terminal and the electrode terminal.

17. The ignition coil assembly according to claim 1, wherein the detachable-insulator is fabricated by molding of heat and chemical resistant polymer composition having a resistivity at 20° C. of at least $10^{13}$ Ω·cm, preferably the polymer composition is based on silicone rubber.

18. The ignition coil assembly according to claim 1, wherein the detachable-insulator includes a composite structure having a tubular plastic body with both ends equipped with rubber connectors.

19. The ignition coil assembly according to claim 1, wherein the terminals connecting insert has both ends being installed with rubber connectors to seal and insulate the high voltage coil terminal and the electrode terminal respectively when the detachable-insulator is excluded from the ignition coil assembly.

20. An ignition system, comprising:

an ignition coil assembly that supplies a high voltage electric current to a resistor-type spark plug, and the ignition coil assembly including:

a terminals connecting insert that connects a high voltage coil terminal of an ignition coil to an electrode terminal of the resistor-type spark plug;

a conductor core of the terminals connecting insert includes a layer of a plurality of elongated fibres of non-metallic carbon fibre or graphite fibre extending side-by side, and disposed at an innermost centre of the terminals connecting insert;

a conductor supporting body stem of the terminals connecting insert forms an insulating and protecting layer around an outside of the fibre conductor core; and a non-detachable-insulator having an interior longitudinally extending passageway to house the high voltage coil terminal of the ignition coil, the terminals connecting insert and the electrode terminal of the resistor-type spark plug.

21. The ignition coil assembly according to claim 20, wherein the elongated fibres of the conductor core are arranged in a bundle, and disposed along the centre line of the terminals connecting insert.

22. The ignition coil assembly according to claim 20, wherein the elongated fibres of the conductor core are derived from fibres selected from a group consisting of carbonization of man-made fibres, and coal tar and petroleum pitch.

23. The ignition coil assembly according to claim 20, wherein the plurality of elongated fibres being coated with conductive composition having a resistivity of below 16 KΩ·m at 15° C., preferably the conductive composition is based on synthetic latex having a resistivity of below 5 KΩ·m.

24. The ignition coil assembly according to claim 20, wherein the terminals connecting insert has a resistance per unit length preferably less than 50 Ω/m., to conduct the high voltage electric current from the high voltage coil terminal to the electrode terminal.

25. The ignition coil assembly according to claim 20, wherein the terminals connecting insert is in a tubular form of the conductor supporting body stem having outside diameter in the range of 2 mm to 20 mm.

26. The ignition coil assembly according to claim 20, wherein the terminals connecting insert includes a retainer supporting body stem having a configuration being branched out from the conductor supporting body stem.

27. The ignition coil assembly according to claim 26, wherein the terminals connecting insert includes the retainer supporting body stem forming an integral molded part with the conductor supporting body stem.

28. The ignition coil assembly according to claim 26, wherein the terminals connecting insert includes a component assembly of retainer supporting body stem with the conductor supporting body stem.

29. The ignition coil assembly according to claim 26, wherein the retainer supporting body stem having outside diameter in the range of 4 mm to 24 mm, that acts as a retainer means to keep the terminals connecting insert remaining in a stable position along the passageway of the non-detachable-insulator during the installation and removal of the resistor-type spark plug, and to uphold the centre line of terminals connecting insert in position adjacent the longitudinal centre lines of the non-detachable-insulator, the high voltage coil terminal and the electrode terminal.

30. The ignition coil assembly according to claim 26, wherein the terminals connecting insert has a configuration design based on the functional design of the conductor supporting body stem and the retainer supporting body stem.

31. The ignition coil assembly according to claim 26, wherein the configuration design of the terminals connecting insert includes the shapes of a cone, rhombus, rectangle, cylindrical, square, triangle and their combinations, preferably derived from the cone shape and its combination.

32. The ignition coil assembly according to claim 26, wherein the terminals connecting insert includes at least one and less than three retainer supporting body stem.

33. The ignition coil assembly or the terminals connecting insert according to claim 20, wherein the conductor supporting body stem and the retainer supporting body stem being fabricated from a polymer composition having a resistivity at 20° C. of at least $10^{13}$ Ω·cm., preferably the polymer composition is based on silicone rubber.

34. The ignition coil assembly according to claim 20, wherein the elongated fibres of the conductor core are in direct contact with the high voltage coil terminal and the electrode terminal.

35. The ignition coil according to claim 20, wherein the terminals connecting insert is terminated for electrical contact with the high voltage coil terminal and the electrode terminal.

36. The ignition coil assembly according to claim 20, wherein the non-detachable-insulator is fabricated by molding of heat and chemical resistant polymer composition derived from engineering plastics and thermosetting resins having a resistivity at 20° C. of at least $10^{13}$ Ω·cm., preferably from the engineering plastics such as polybutylene terephthalate.

37. The ignition coil assembly according to claim 20, wherein the non-detachable-insulator forms an integral part of the ignition coil.

38. The ignition coil assembly according to claim 36, wherein the non-detachable-insulator includes an outside layer of elastic sleeve being fabricated from an elastomeric composition, preferably silicone rubber, to protect the non-detachable-insulator against dielectric leaking upon performance ageing.

* * * * *